United States Patent [19]

Westbrook

[11] 4,118,031

[45] Oct. 3, 1978

[54] AMUSEMENT TOY OR GYRO DISC

[76] Inventor: Samuel T. Westbrook, 5650 Orly Ter., College Park, Ga. 30349

[21] Appl. No.: 634,183

[22] Filed: Nov. 21, 1975

[51] Int. Cl.[2] ..... A63F 9/00

[52] U.S. Cl. ..... 273/110

[58] Field of Search ..... 273/1 R, 1 E, 1 M, 108, 273/109, 110, 126 R, 128 R, 128 A; 40/32, 96; 46/47, 1 R, 1 C

[56] References Cited

U.S. PATENT DOCUMENTS

| | | | |
|---|---|---|---|
| 1,572,069 | 2/1926 | Kline | 273/109 |
| 1,781,333 | 11/1930 | Lehmann et al. | 273/110 X |
| 2,858,643 | 11/1958 | Stanley | 46/47 X |
| 3,672,674 | 6/1972 | Reed | 273/1 M |
| 3,817,529 | 6/1974 | Dobbins | 273/128 A X |
| 3,967,824 | 7/1976 | Lund | 273/110 |

FOREIGN PATENT DOCUMENTS

| | | | |
|---|---|---|---|
| 1,031,011 | 5/1966 | United Kingdom | 273/109 |

*Primary Examiner*—Richard J. Apley
*Attorney, Agent, or Firm*—Willard R. Crout

[57] ABSTRACT

An amusement toy, or "Gyro Disc" comprises a hand-held platform in which a moving conveyor-belt is provided to effect the constant rotaton, as long as possible, of a free-wheeling disc, or wheel. The platform may, alternately, be table-mounted with an adjusting means for tilting the platform to accommodate various movements of the rotating disc. The object of the amusement device is to test one's skill in keeping the disc rotating and balanced by gyroscopic action as long as possible, while holding, or manipulating the platform in which the moving conveyor belt is mounted.

5 Claims, 6 Drawing Figures

FIG.3
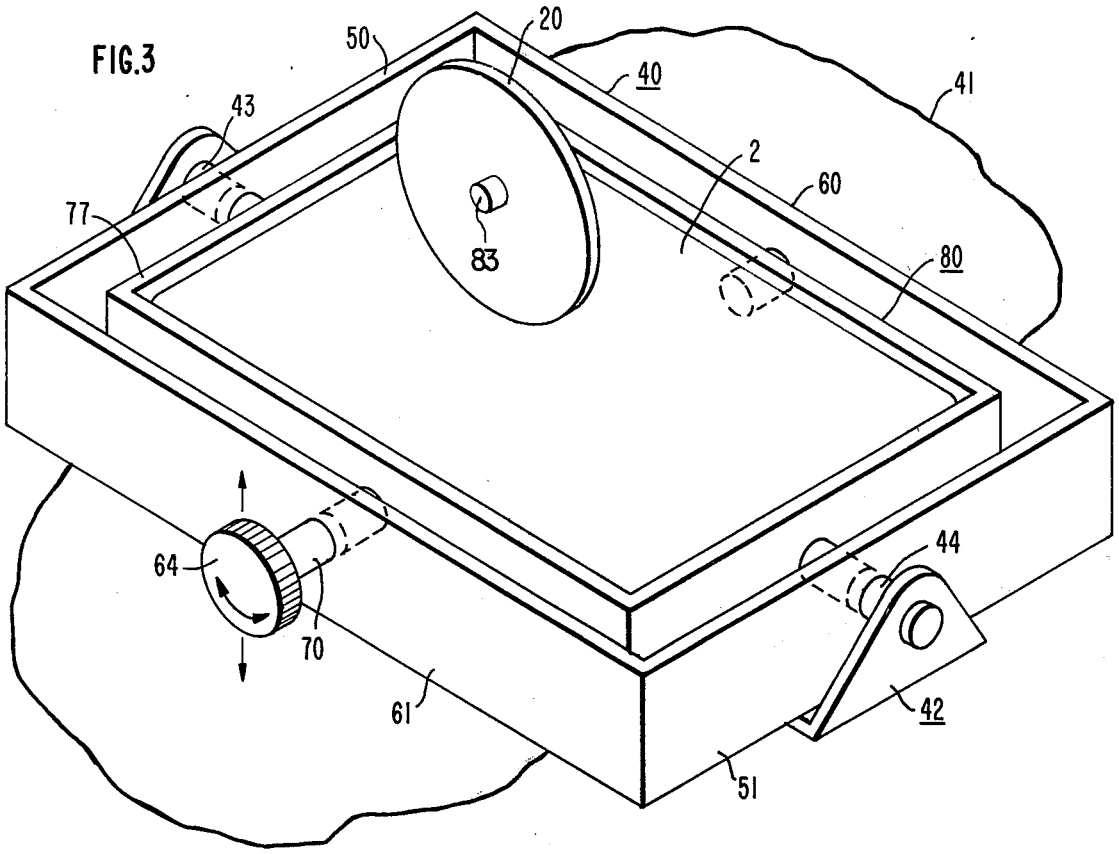
FIG.5
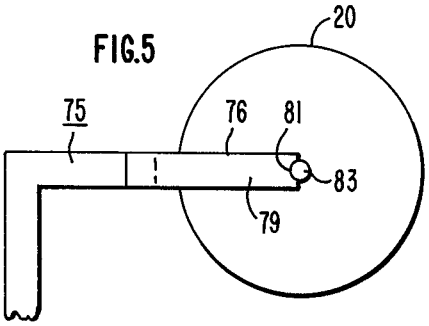
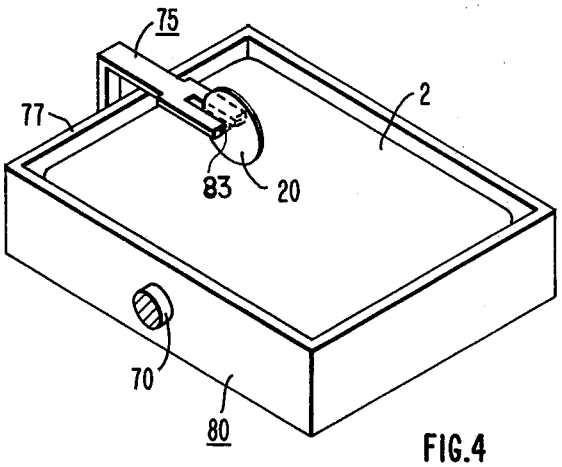
FIG.4
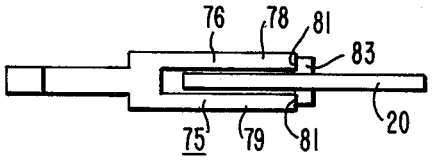
FIG.6

AMUSEMENT TOY OR GYRO DISC

CROSS-REFERENCE TO RELATED APPLICATIONS

Applicant is not aware of any related patent applications pertinent to the present invention.

BRIEF SUMMARY OF THE INVENTION

A moving conveyor-belt is provided being mounted and supported in a surrounding box, or platform, the latter being adapted for selective manual manipulative tilting, or movement, so as to constantly effect rotation of a wheel, or disc, which is kept moving and balanced by gyroscopic action by the longitudinal movement of the conveyor-belt.

The amusement device may either be hand-held by the player, and a crank-arm, or other manual means then provided to effect rotation of the moving conveyor-belt, or, alternately, the amusement device is adaptable for table-mounting, in which an electric motor, or other means, for example, may be utilized to effect rotation of the conveyor-belt rollers (instead of the manual means). In the table-mounted modification, an adjusting knob, for example, may effect tilting manipulative rotation of the box, or platform within which the conveyor-belt is disposed.

BRIEF DESCRIPTION OF THE DRAWINGS

FIG. 3 indicates another possible modification of the invention, in which the device is adapted for table mounting, and a manipulating knob is provided so as to manipulate the position of the internally-disposed box, or platform, the latter supporting the moving conveyor-belt;

FIG. 4 is a perspective view of the conveyor-belt mounting box utilized in the modification of FIG. 3, and, additionally, showing a support for the rotating disc at the beginning of the manipulating operation;

FIG. 5 is an enlarged view of the support for the disc, which may be affixed, or removably attached to the conveyor-belt box; and, FIG. 6 is a top plan view looking down at the disc and holder of FIG. 5.

DESCRIPTION OF THE PREFERRED EMBODIMENTS

Figure 1:
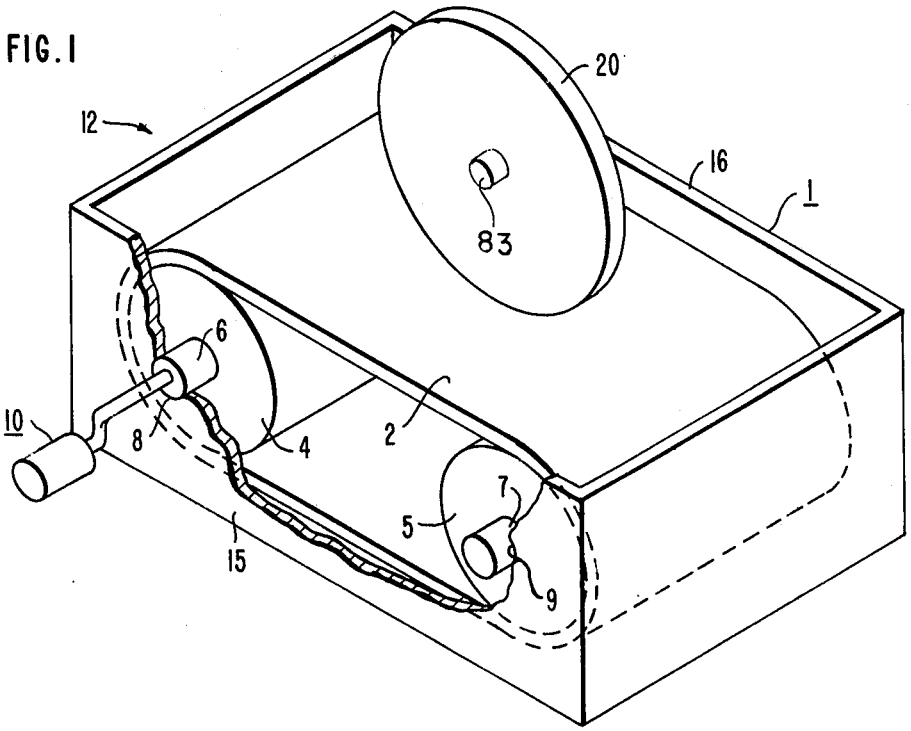
FIG. 1 is a perspective view with one side, partially broken away, of the hand-held version of the amusement device and indicating hand-crank operation of the converyor-belt.

Referring to FIG. 1, the reference numeral 1 generally designates a supporting box, or platform within which a moving conveyor-belt 2 is provided. The moving conveyor-belt 2 may be operated by means of a pair of spaced conveyor-rollers 4, 5, having their mounting or pivot pins 6, 7 disposed in suitably-provided apertures 8, 9 located in the outer sides of the generally-rectangularly-shaped box, or platform 1.

A manually-operable hand-crank 10 may be provided which can be manually turned by the player. In so doing, it will be obvious that the manual rotation of the hand-crank 10 will, in turn, effect operative rotation of the conveyor-roller 4, pulling, by friction, the conveyor-belt 2, and thereby causing the companion conveyor-roller 5 to also turn. It will, of course, be apparent that the companion roller 5 may be free-wheeling in its bearings 9 provided in the side-walls 15, 16 of the supporting box, or platform 1.

The moving conveyor-belt 2 may be fabricated of any suitable elastomeric material, such as rubber, or, alternatively, of leather, a suitable resinous composition, or any other suitable material, as desired.

The object of the amusement device 12 is to keep moving as long as possible a free-wheeling disc, or wheel 20, the latter being supported upon the top surface of the moving conveyor belt 2, and the supporting platform, or box 1 manipulated by the player to prevent the disc 20 from moving off the conveyor belt, and to attempt to maintain its constant upright rotation as long as possible. The device may be used as an amusement game to test one's skill in keeping the disc 20 rotating as long as possible, while holding or manipulating the hand-held platform.

Figure 2:
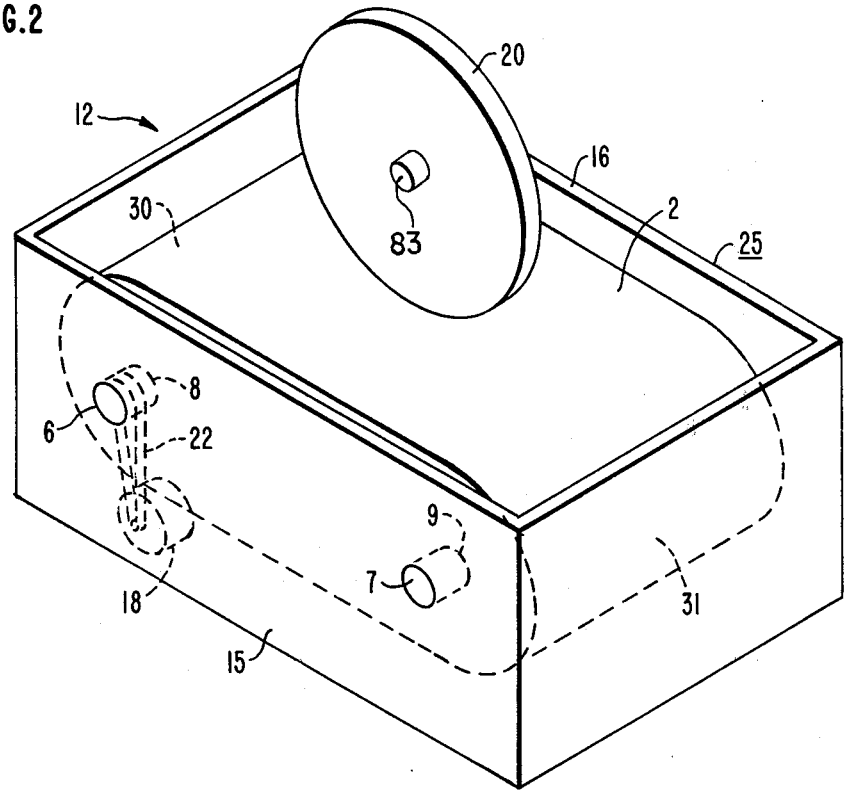
FIG. 2 illustrates a modification of the invention in which the conveyor-belt is motor-driven.

FIG. 2 shows an alternative form of the invention, in which instead of a hand-crank, or other manual means being provided, as exemplified by the hand-crank of FIG. 1, instead, an electrical motor 18, with a belt-drive 22 being mounted within the outer supporting conveyor box 25 to effect thereby rotation of the spaced conveyor rollers 30 and 31. The utilization of an electrical motor 18 instead of the hand-crank 10 permits the player to perhaps concentrate more on the manipulation, and positioning of the outer supporting box 25, rather than having to simultaneously effect rotation of a hand-crank 10, as was the case with the device of FIG. 1.

The other features of the amusement device 12 of FIG. 2 of the drawings are otherwise identical to the device 12 described heretofore in connection with FIG. 1, except that the motor 18 and the motor-belt drive 22, or gear drive, or friction drive, are provided to effect automatic rotation of the spaced conveyor-rollers 30, 31. The rotating disc 20, as before, is again attempted to be continuously rotated and balanced as long as possible by the player.

FIG. 3 illustrates still a further modification 40 of the invention, which is adaptable for table mounting. As shown, the amusement device 40 is adapted to be mounted upon a table 41, or other supporting platform by means of a support framework 42. As shown, the supporting framework 42 is of generally U-shaped configuration fixedly supporting bearings-pins 43, 44, which pivotally engage the end side walls 50, 51 of an outer adjustment support box 60. Extending through a lateral side wall 61 of the outer adjustment support box 60 is a manipulating knob 64, which is grasped by the player to effect tilting rotation of the outer support box 60. It will be noted, however, that the adjusting rod 70, affixed to the adjusting knob 64, extends inwardly into an interiorly-disposed conveyor-belt box, or second support platform 80, (FIG. 4), the construction of which is similar to that described heretofore in connection with the embodiments of FIGS. 1 and 2. Preferably, the conveyor-belt 2, disposed within the inner conveyor-belt box 80, is motor-driven, as in the version of the invention shown in FIG. 2.

Thus, the device 40 functions to first energize the motor 18 (not shown in FIG. 3), which effects longitudinal movement of the conveyor belt 2. The disc 20 is initially supported by a bracket, or holder 75, which may be removably affixed to the end 77 of the inner support box 80.

FIGS. 5 and 6 illustrate more in detail the construction of the holder 75. As shown, it is generally of a right-angled bracket construction having a bifurcated portion 76, the furcations 78, 79 of which have notches 81, which accommodate a center pivot-pin 83 of the rotatable disc, or wheel 20.

Thus, to begin or to start the game, the holder 75 is removably affixed by any suitable means to the end side wall 77 of the inner conveyor-belt support box 80, and the wheel 20 placed in position, as shown in FIG. 4, against the notches 81. Upon energization of the conveyor-belt motor 18, the belt 2 will begin its longitudinal travel, or motion thereby effecting rotation of the wheel 20. At this point, the holder 75 may be manually removed, while the adjustment wheel 64 is manipulated by the player to effect a desirable tilting of the outer and inner support boxes 60, 80. It will be observed that by manipulation of the single manual knob 64 not only may be outer platform supporting box 60 be rotated, but by a twisting of the knob 64 itself, a desirable rotation and tilting is effected of the inner conveyor-belt supporting box 80 may additionally be provided.

Other embodiments may include: Having the said motor 18 be powered by batteries located within the conveyor-belt supporting box 80, or be powered by an external source. Having said motor 18 be reversible and able to vary its speed by appropriate controls. To remotely control: the tilting of the outer support box 60, and the tilting of the inner support box 80, and the speed and direction of the motor 18.

While only a few embodiments of the present invention have been shown and described, it will be obvious that many changes and modifications may be made thereunto without departing from the spirit and scope of the invention.

What is claimed is:

1. An amusement toy comprising a conveyor-belt, manipulative and tiltable means supporting said conveyor-belt for longitudinal movement, means for effecting longitudinal movement of said conveyor belt, and a single sole playing disc adapted to be rotated and balanced by the longitudinal movement of said conveyor-belt and manipulative tilting of said supporting means.

2. The combination according to claim 1, wherein said supporting means comprises a support box having a pair of laterally-spaced conveyor-belt rollers about which are positioned the conveyor-belt, and means is provided to effect rotation of at least of one of said conveyor-rollers.

3. The combination according to claim 2, wherein a hand-crank or other manual means is associated with one of the conveyor rollers to thereby enable the longitudinal movement of the conveyor-belt to be provided by crank-operation.

4. The combination according to claim 2, wherein an electrical motor or other mechanical means is utilized to effect rotation of one of the conveyor-rollers.

5. A manipulative toy comprising, in combination:

a loop-shaped conveyor-belt, tiltable and manipulative supporting means for mounting and effecting longitudinal movement of said loop-shaped conveyor-belt, only a single sole playing disc supported on said moving conveyor-belt and rotated thereby, whereby a participating player may manipulate and tilt said supporting means for thereby balancing the sole rotating playing disc and maintaining its position upon the conveyor-belt.

* * * * *